US008950513B2

(12) United States Patent
Montgomery

(10) Patent No.: US 8,950,513 B2
(45) Date of Patent: Feb. 10, 2015

(54) APPARATUS AND METHODS FOR CONTROLLING DRILL STRING VIBRATIONS AND APPLYING A FORCE TO A DRILL BIT

(71) Applicant: Matthew Montgomery, Spring, TX (US)

(72) Inventor: Matthew Montgomery, Spring, TX (US)

( * ) Notice: Subject to any disclaimer, the term of this patent is extended or adjusted under 35 U.S.C. 154(b) by 206 days.

(21) Appl. No.: 13/573,688

(22) Filed: Oct. 3, 2012

(65) Prior Publication Data

US 2014/0090892 A1 Apr. 3, 2014

(51) Int. Cl.

| | |
|---|---|
| ***E21B 17/20*** | (2006.01) |
| ***E21B 17/10*** | (2006.01) |
| ***E21B 17/07*** | (2006.01) |

(52) U.S. Cl.

CPC ..... *E21B 17/1014* (2013.01); *E21B 17/076* (2013.01)

USPC ..... 175/325.2; 175/57; 267/136; 464/20

(58) Field of Classification Search

CPC ... E21B 17/1014; E21B 17/076; E21B 17/10; E21B 17/07; E21B 17/073; E21B 17/02

USPC ..... 175/57, 322, 325.2, 56; 267/136, 134; 464/20, 21, 23, 87, 97, 18, 27

See application file for complete search history.

(56) References Cited

U.S. PATENT DOCUMENTS

| | | | | |
|---|---|---|---|---|
| 2,570,577 | A | 10/1951 | Manion | |
| 3,122,902 | A * | 3/1964 | Blair et al. | 464/21 |
| 3,230,740 | A | 1/1966 | Fox | |
| 3,339,380 | A | 9/1967 | Fox | |
| 4,552,230 | A | 11/1985 | Anderson | |
| 4,630,809 | A | 12/1986 | Duckworth | |
| 6,736,223 | B2 | 5/2004 | Odell, II | |
| 7,025,142 | B2 | 4/2006 | Crawford | |
| 7,044,219 | B2 | 5/2006 | Mason | |
| 7,578,360 | B2 | 8/2009 | Haughom | |
| 8,146,680 | B2 | 4/2012 | Mock | |
| 2012/0228028 | A1 * | 9/2012 | Turner et al. | 175/56 |

* cited by examiner

*Primary Examiner* — Yong-Suk (Philip) Ro

(57) ABSTRACT

Apparatus and methods for controlling drill string vibrations and applying a force to a drill bit include a body having a first piston at an uphole end in association with a drill string and a second piston at a downhole end in association with a drill bit. A first biasing member urges the first piston outward to provide a first force in an uphole direction to the drill string. A second biasing member urges the second piston outward to provide a second force in a downhole direction to the drill bit. When vibration from the drill string compresses the first biasing member, the first force resists the vibration and maintains the apparatus and drill bit in a consistent orientation. When an uphole force from the drill string or the drill bit compresses the second biasing member, the second force prevents movement of the drill bit in an uphole direction.

13 Claims, 2 Drawing Sheets

APPARATUS AND METHODS FOR CONTROLLING DRILL STRING VIBRATIONS AND APPLYING A FORCE TO A DRILL BIT

FIELD

Embodiments usable within the scope of the present disclosure relate, generally, to apparatus and methods usable for controlling vibrations within a drill string and applying a downhole force to a drill bit, and more specifically, to devices and methods for maintaining weight-on-bit during drilling operations while preventing vibrational forces from a drill string from interfering with operation of the drill bit.

BACKGROUND

When drilling a wellbore, the drill bit and drill string, as well as other associated equipment, are subject to various forces. For example, during drilling, the drill bit is subject to a counterforce in the uphole direction applied by the formation, rotational force from the motive source being used to drill, excess torque from the drill string, vibrational forces from the drill string and/or other equipment located uphole from the drill bit, and/or other similar forces. These and other types of forces can briefly lift the drill bit from the bottom of a wellbore (e.g., creating "bit whirl"), and/or cause the drill bit to be subjected to undesirable lateral forces, which can result in the drill bit and/or drill string becoming stuck, an undesired deviation of the direction in which the wellbore is drilled, and other losses in drilling efficiency, as well as possible wear and/or damage to equipment. Further, in addition to lifting and/or deviating the drill bit, vibration of the drill string can cause the drill string, itself, and/or other components associated therewith, to contact the borehole wall, becoming stuck, damaged, and/or reducing drilling efficiency.

As such, during drilling operations, it is important to maintain an adequate "weight-on-bit" to counteract the tendency of the drill bit to be lifted from the bottom of the wellbore and/or to deviate from the desired direction of drilling. During vertical drilling operations, the weight of the drill string, itself, as well as the weight of one or multiple drill collars, stabilizers, and/or other components, placed just above the drill bit in a bottomhole assembly, provides significant weight to the drill bit, which not only maintains contact between the bit and the formation to reduce deviation, but also improves the rate of drilling. However, during horizontal drilling and/or drilling in any other non-vertical direction, the weight of the drill string, bottomhole assembly, and/or other components associated with the drill string provides significantly less benefit, and in many cases, may hinder directional drilling operations through undesired contact between the drill string and/or any tools or components therealong and the borehole wall, especially when passing through curved/bent portions of the wellbore.

Conventionally, during horizontal drilling operations, a thruster, tractor, and/or shock absorber can be installed, proximate to the drill bit. A typical thruster will use hydraulic elements (e.g., pistons and cylinders) to apply a constant force to the drill bit to maintain the bit on the bottom of the wellbore. A tractor will use hydraulic elements to pull and/or push on the drill string or drill bit. A shock absorber will include resilient and/or similar elements designed to cushion all components on one side of the shock absorber from forces received from components on the opposing side. Each of these types of tools, used singularly or in combination, provides some effectiveness when attempting to improve drilling efficiency, maintain a drill bit on the bottom of a wellbore, and reduce the effect of drill string vibration on a drill bit. However, a need exists for devices specifically designed to apply an uphole force in the direction of the drill string to reduce the inefficiencies and difficulties caused by drill string vibration on the drill string itself, not simply the drill bit. A need also exists for devices and methods for simultaneously applying a downhole force to maintain an acceptable weight-on-bit, and an uphole force usable to control drill string vibrations.

SUMMARY

Embodiments usable within the scope of the present disclosure include apparatus for controlling drill string vibrations and applying a force to a drill bit. Such an apparatus can include a body with an uphole end and a downhole end, having a first piston (e.g., a mandrel, rod, etc.) positioned at the uphole end and a second piston positioned at the downhole end. A first biasing member (e.g., one or more Bellville springs or similar members) can be operatively associated with the first piston, and the first biasing member can be configured to urge the first piston outwardly from the body to provide a first force in an uphole direction to a drill string, which can be engaged with the uphole end of the body. A second biasing member can be operatively associated with the second piston and configured to urge the second piston outwardly from the body to provide a second force in a downhole direction to a drill bit, which can be engaged with the downhole end of the body. Vibrations from the drill string can thereby compress the first biasing member (e.g., through contact between the drill string and the first piston), while the first force resists the vibration and maintains the body and drill bit in a generally constant orientation relative to the drill string. Uphole forces from the drill string and/or the drill bit can compress the second biasing member, while the second force prevents movement of the drill bit in an uphole direction (e.g., maintaining weight-on-bit.)

A specific embodiment can include a tubular housing having an axial bore with a first end and a second end, a first mandrel positioned within the first end and movable in an axial direction relative to the housing, and a second mandrel positioned within the second end and movable in an axial direction relative to the housing. A spring mandrel can be positioned within the axial bore between the ends thereof. At least one first biasing member can thereby be positioned between the spring mandrel and the first mandrel, while at least one second biasing member can be positioned between the spring mandrel and the second mandrel. A vibrational force from the drill string can move the first mandrel into the axial bore, thereby compressing the one or more first biasing members, which apply a vibrational counterforce that resists the vibration. An uphole force from the drill bit can move the second mandrel into the axial bore, thereby compressing the one or more second biasing members, which apply a downhole counterforce that prevents movement of the drill bit in an uphole direction.

In use, an apparatus can be provided into a wellbore, the apparatus having a first end adapted to contact and apply a force to a drill bit and a second end adapted to contact and apply a force to a drill string. The drill bit can be used to bore through a formation, such that the formation can apply an uphole force to the drill bit that compresses a first biasing member associated with the first end. The first biasing member can thereby apply a downhole counterforce to the bit to prevent movement of the drill bit in an uphole direction. The drill string can be extended into the wellbore, which can apply a vibrational force to the apparatus, which can thereby compress a second biasing member associated with the second end of the apparatus. The second biasing member can thereby apply an uphole counterforce to the drill string to resist the vibrational force and maintain the drill bit and apparatus in a generally consistent orientation relative to the drill string.

BRIEF DESCRIPTION OF THE DRAWINGS

In the detailed description of various embodiments usable within the scope of the present disclosure, presented below, reference is made to the accompanying drawings, in which.

One or more embodiments are described below with reference to the listed Figures.

DETAILED DESCRIPTION OF THE EMBODIMENTS

Before describing selected embodiments of the present disclosure in detail, it is to be understood that the present invention is not limited to the particular embodiments described herein. The disclosure and description herein is illustrative and explanatory of one or more presently preferred embodiments and variations thereof, and it will be appreciated by those skilled in the art that various changes in the design, organization, means of operation, structures and location, methodology, and use of mechanical equivalents may be made without departing from the spirit of the invention.

As well, it should be understood that the drawings are intended to illustrate and plainly disclose presently preferred embodiments to one of skill in the art, but are not intended to be manufacturing level drawings or renditions of final products and may include simplified conceptual views to facilitate understanding or explanation. As well, the relative size and arrangement of the components may differ from that shown and still operate within the spirit of the invention.

Moreover, it will be understood that various directions such as "upper", "lower", "bottom", "top", "left", "right", and so forth are made only with respect to explanation in conjunction with the drawings, and that components may be oriented differently, for instance, during transportation and manufacturing as well as operation. Because many varying and different embodiments may be made within the scope of the concept(s) herein taught, and because many modifications may be made in the embodiments described herein, it is to be understood that the details herein are to be interpreted as illustrative and non-limiting.

Figure 1:
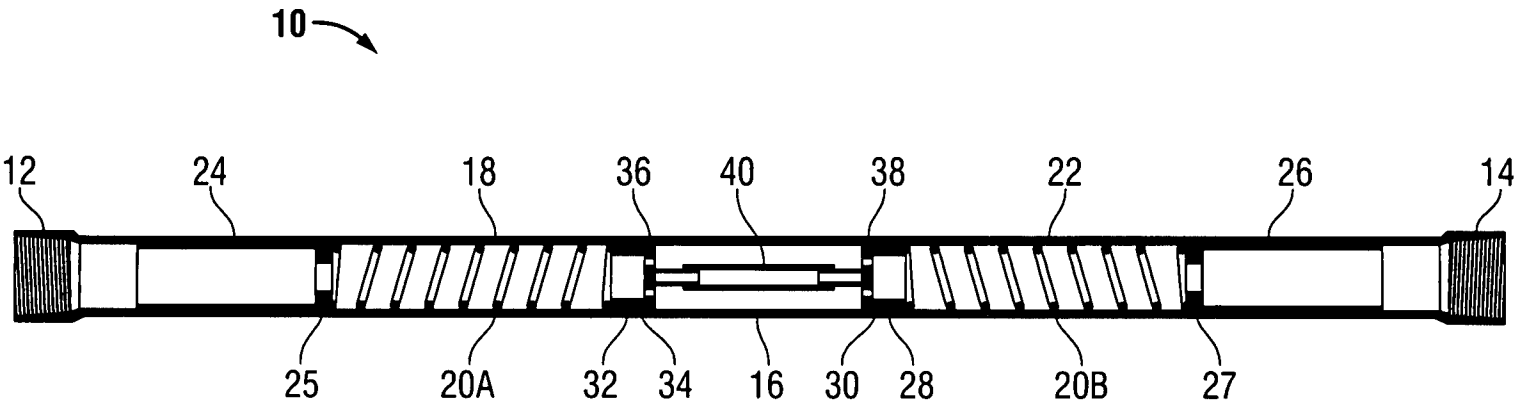
FIG. 1 depicts a diagrammatic side view showing an embodiment of an apparatus usable within the scope of the present disclosure.

Referring now to FIG. 1, a diagrammatic side view of an embodiment of an apparatus (10) usable within the scope of the present disclosure is shown. While in operation, the depicted portions of the apparatus (10) can be provided within a tubular housing (not shown), which can be engaged with adjacent joints and/or components within a drill string at each end (e.g., via threaded connections), FIG. 1 depicts the apparatus (10) without an outer housing to promote visibility of the interior portions thereof.

A first piston or mandrel (12) is shown positioned at a first end of the apparatus (10), attached via a splined connection (24) and left handed threads (25), such that the first mandrel (12) can move axially relative to other portions of the apparatus (10) (e.g., inward and outward parallel to the longitudinal axis of the apparatus (10)). A second piston/mandrel (14) is shown positioned at a second end of the apparatus (10), similarly attached via a splined connection (26) and left handed threads (27) such that the second mandrel (14) can be movable in an axial direction relative to other portions of the apparatus (10). While FIG. 1 depicts each mandrel (12, 14) being substantially identical, in an embodiment, the mandrels (12, 14) could have differing dimensions, shapes, and/or materials, depending on the nature of the drill bit, drill string, and/or other components. Further, while FIG. 1 depicts use of splined connections (24, 26) and left handed threads (25, 27), it should be understood that any means of connection and/or association between the mandrels (12, 14) and the remainder of the apparatus (10) can be used without departing from the scope of the present disclosure.

A spring mandrel (16) is shown generally centrally located within the apparatus (10) (e.g., between the ends thereof, and between the first and second mandrels (12, 14)), the spring mandrel (16) engaging and/or directly/indirectly contacting the other portions of the apparatus (10).

A first spring housing (18) is depicted between the spring mandrel (16) and the first mandrel (12). The spring housing (18) can, in an embodiment, include a generally tubular body about which a plurality of Bellville springs or similar biasing members can be positioned, of which two exemplary springs (20A, 20B) are depicted. As such, the first mandrel (12) can be placed in association with a drill string (not shown) located uphole from the apparatus (10), such that vibrations and/or other forces from the drill string can impart a downhole force to the first mandrel (12), which can cause axial movement of the first mandrel (12) relative to other portions of the apparatus (10), by compressing the biasing members (20A, 20B) along the first spring housing (18). The compression of the biasing members (20A, 20B) and movement of the first mandrel (12) can be limited by, for example, use of a stop nut (32), which is shown engaged with the spring mandrel (16) via a cap and/or associated section of wash pipe (34). Other configurations and/or stop members can also be used without departing from the scope of the present disclosure. For example, a shoulder and/or similar protruding feature of the first mandrel (12) could be used to limit the movement thereof, through contact with a corresponding feature located elsewhere along the apparatus (10) and/or the housing thereof. A sub (36) (e.g., a crossover sub usable to connect components of differing diameters and/or dimensions) can be positioned between the stop nut (32) and the first mandrel (12) to provide a desired spacing therebetween. In an embodiment, the first mandrel (12) can have a stroke length (e.g., a maximum compression distance) of approximately two feet. The biasing members (20A, 20B) can be configured to urge the first mandrel (12) outwardly from the apparatus (10) (e.g., in an uphole direction), such that compression of the biasing members applies a counterforce to the drill string, thereby minimizing the effect of any downhole and/or vibrational force on the apparatus (10) and on the drill bit below.

A second spring housing (22) is shown between the spring mandrel (16) and the second mandrel (14). The second spring housing (22) can similarly include a tubular body about which biasing members (e.g., Bellville springs or similar members) are positioned. The second mandrel (14) can be placed in association with a drill bit (not shown) located downhole from the apparatus (10), such that an uphole force from the drill bit (e.g., a force that has the tendency to lift the drill bit from the bottom of the wellbore) will be applied to the second mandrel (14), which can cause axial movement of the second mandrel (14), relative to other portions of the apparatus (10), by compressing the biasing members positioned along the second spring housing (22). Compression of the biasing members and movement of the second mandrel (14) can be limited by using a stop nut (28), which is shown engaged with the spring mandrel (16) via a cap and/or associated section of wash pipe (30), though other configurations and/or stop members can be used without departing from the scope of the present disclosure, as described above. A sub (38) (e.g., a crossover sub) can be positioned between the stop nut (28) and the second mandrel (14) to provide a desired spacing therebetween. In an embodiment, the second mandrel (14) can have a stroke length (e.g., a maximum compression distance) of approximately two feet. The biasing members along the spring housing (22) can be configured to urge the second mandrel (14) outwardly from the apparatus (10) (e.g., in a downhole direction), such that compression of the biasing members, e.g., by an associated drill bit, can cause a counterforce to be applied to the drill bit, thereby maintaining contact between the drill bit and the bottom of the wellbore.

In an embodiment, a piston sub (40) or similar member can be positioned within the interior of the apparatus (10) (e.g., within a hollow spring mandrel). For example, the piston sub (40) can engage the first and second mandrels (12, 14) (e.g., via the splined connections (24, 26)), while the spring mandrel (16) can engage the subs (36, 38) and spring housings (18, 22). In an alternative embodiment, the piston sub (40) could be positioned external to the spring mandrel (16) and/or other portions of the apparatus.

Figure 2A:
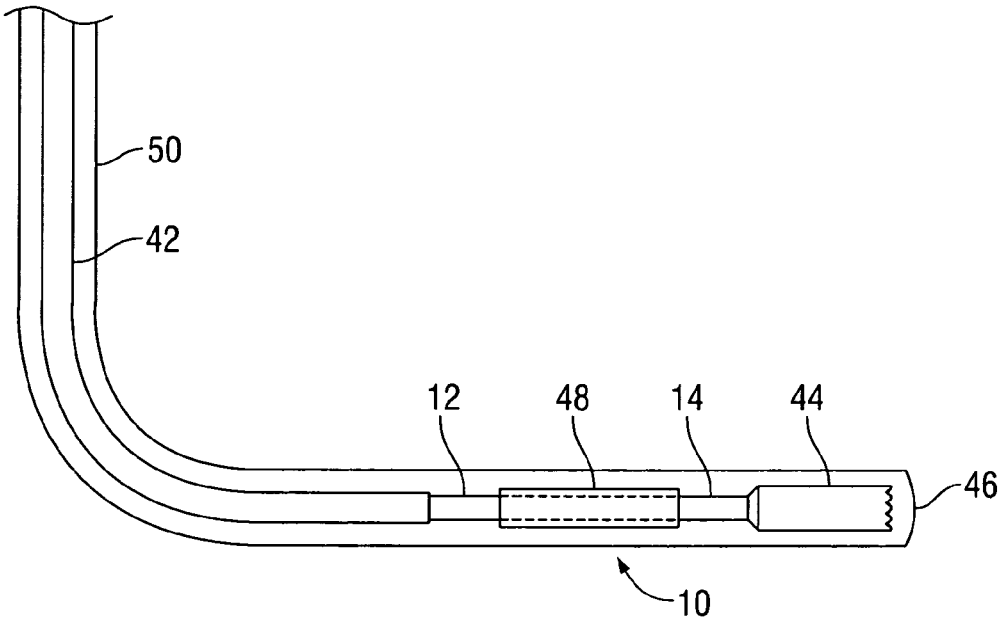
FIG. 2A depicts a diagrammatic side view showing an embodiment of an apparatus usable within the scope of the present disclosure positioned within a wellbore.

Referring now to FIG. 2A, an embodiment of an apparatus (10) usable within the scope of the present disclosure is shown positioned within a directional wellbore (50). As known in the art, the wellbore (50) is shown having a drill string (42) therein having a drill bit (44) at the distal end thereof. The drill bit (44) can be used to extend the wellbore (50) by boring into the downhole end (46) thereof. It should be understood that the diagram shown in FIG. 2A is simplified, to show the general position of the apparatus (10) relative to the drill string (42) and drill bit (44), and that various other components (e.g., a mud motor, a measurement-while-drilling device, and/or other components) not specifically depicted, but well known in the art, can also be present. The apparatus (10) is shown having an outer housing (48) within which the remainder thereof is positioned, and from within which the first and second mandrels (12, 14) extend. The first mandrel (12) is shown in association with the drill string (42), while the second mandrel (14) is shown in association with the drill bit (44).

Figure 2B:
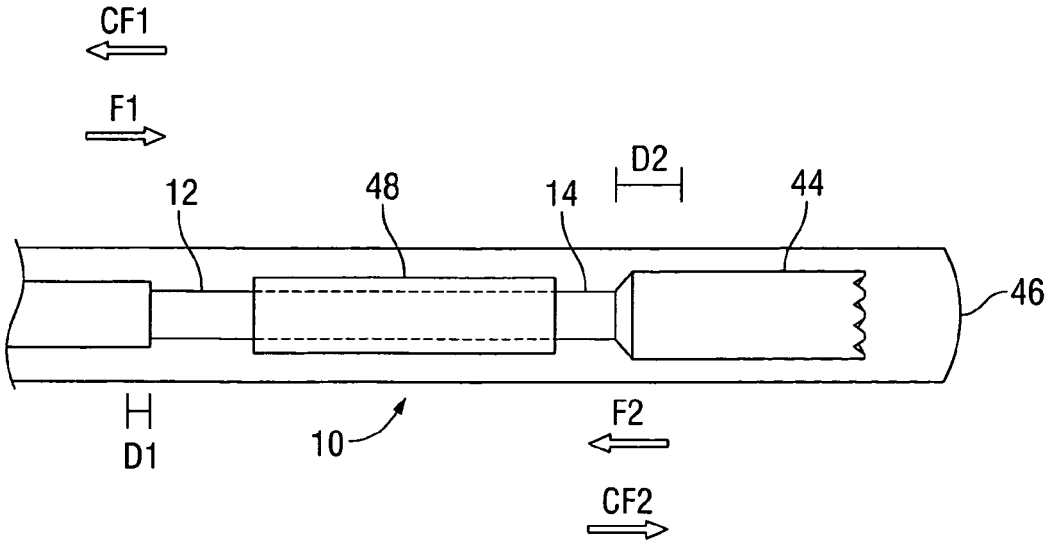
FIG. 2B depicts a diagrammatic side view showing the apparatus of FIG. 2A operatively associated with a drill string and a drill bit.

FIG. 2B depicts the apparatus (10) of FIG. 2A during a drilling operation. The drill string (42, labeled in FIG. 2A) is shown imparting a vibrational force (F1) to the first mandrel (12) in a downhole direction, which compresses biasing members (shown in FIG. 1) associated with the first mandrel (12), such that the first mandrel (12) retracts a first distance (D1) into the housing (48). The biasing members exert an equal and opposite counterforce (CF1) in an uphole direction, which reduces and/or eliminates the effect of the vibrational force (F1) on the remainder of the apparatus (10) and on the drill bit (44) and any other components located downhole from the apparatus (10).

The drill bit (44) is shown imparting an uphole force (F2) (e.g., a force that would tend to lift the drill bit (44) from the downhole end (46) of the wellbore (50, labeled in FIG. 2A)) to the second mandrel (14), which compresses biasing members associated with the second mandrel (14), such that the second mandrel (14) retracts a second distance (D2) into the housing. The biasing members associated therewith exert an equal and opposite counterforce (CF2) in a downhole direction, which reduces and/or eliminates the effect of the uphole force (F2) on the remainder of the apparatus (10) and on the drill string (42) and other components associated therewith, while also urging the drill bit (44) into contact with the downhole end (46) of the wellbore (50).

While FIG. 2B depicts the uphole force (F2) having a greater magnitude than the vibrational force (F1), such that the second counterforce (CF2) and second distance (D2) are greater than the first counterforce (CF 1) and first distance (D1), it should be understood that the forces illustrated in FIG. 2B are merely exemplary of one possible set of circumstances that may be encountered within a wellbore, and that embodiments of the present apparatus (10) can be used to compensate for any magnitude of force.

While various embodiments usable within the scope of the present disclosure have been described with emphasis, it should be understood that within the scope of the appended claims, the present invention can be practiced other than as specifically described herein.

What is claimed is:

1. An apparatus for controlling vibrations of a drill string and applying a force to a drill bit, the apparatus comprising:

a body having an uphole end and a downhole end, wherein the body comprises a first piston positioned at the uphole end and a second piston positioned at the downhole end;

a first biasing member operatively associated with the first piston, wherein the first biasing member urges the first piston outward from the body to provide a first force in an uphole direction to the drill string engaged with the uphole end;

a second biasing member operatively associated with the second piston, wherein the second biasing member urges the second piston outward from the body to provide a second force in a downhole direction to the drill bit engaged with the downhole end; and an outer housing and an inner member within the housing, wherein a first end of the inner member engages the first biasing member and a second end of the inner member engages the second biasing member, wherein compression of the first biasing member enables the first piston to move within the outer housing and external to the inner member, and wherein compression of the second biasing member enables the second piston to move within the outer housing and external to the inner member, wherein a vibration from the drill string compresses the first biasing member such that the first force resists the vibration and maintains the body and the drill bit in a generally consistent orientation relative to the drill string, and wherein an uphole force from the drill string, the drill bit, or combinations thereof, compresses the second biasing member such that the second force prevents movement of the drill bit in an uphole direction.

2. The apparatus of claim 1, wherein the first biasing member, the second biasing member, or combinations thereof comprise at least one Belleville spring.

3. The apparatus of claim 1, wherein the first piston, the second piston, or combinations thereof, is adapted to move relative to the body a distance of two feet or more.

4. The apparatus of claim 1, wherein the first piston, the second piston, or combinations thereof, is adapted to move relative to the body a distance of two feet or less.

5. A method for controlling vibrations of a drill string and applying a force to a drill bit, the method comprising the steps of:

providing an apparatus into a wellbore, wherein the apparatus comprises a first end adapted to contact and apply a force to the drill bit, a second end adapted to contact and apply a force to the drill string, a body, a first piston associated with the first end, a second piston associated with the second end, an outer housing, and an inner member within the housing;

using the drill bit to bore through a formation, wherein the formation applies an uphole force to the drill bit, wherein the uphole force compresses a first biasing member associated with the first end of the apparatus and engaging a first end of the inner member, wherein compressing the first biasing member moves the first piston relative to the body, within the outer housing and external to the inner member, and wherein the first biasing member applies a downhole counterforce to the drill bit to prevent movement of the drill bit in an uphole direction; and extending the drill string into the wellbore thereby applying a vibrational force to the drill string, wherein the vibrational force compresses a second biasing member associated with a second end of the apparatus and engaging a second end of the inner member, wherein compressing the second biasing member moves the second piston relative to the body, within the outer housing and external to the inner member, and wherein the second biasing member applies an uphole counterforce to the drill string to resist the vibrational force and maintain the drill bit and the apparatus in a generally consistent orientation relative to the drill string.

6. The method of claim 5, wherein the first piston, the second piston, or combinations thereof, move a distance of two feet or greater relative to the body.

7. The method of claim 5, wherein the first piston, the second piston, or combinations thereof, move a distance of two feet or less relative to the body.

8. An apparatus for controlling vibrations of a drill string and applying a force to a drill bit, the apparatus comprising:

a tubular housing having an axial bore with a first end and a second end;

a first mandrel positioned within the first end of the axial bore and movable in a first axial direction relative to the tubular housing;

a second mandrel positioned within the second end of the axial bore and movable in a second axial direction relative to the tubular housing;

a spring mandrel positioned within the axial bore between the first end and the second end;

at least one first biasing member positioned between the spring mandrel and the first mandrel; and at least one second biasing member positioned between the spring mandrel and the second mandrel, wherein a vibrational force from the drill string moves the first mandrel into the axial bore, thereby compressing said at least one first biasing member, wherein said at least one first biasing member applies a vibrational counterforce that resists the vibration and maintains the tubular housing and the drill bit in a generally consistent orientation relative to the drill string, wherein an uphole force from the drill bit moves the second mandrel into the axial bore, thereby compressing said at least one second biasing member, and wherein said at least one second biasing member applies a downhole counterforce that prevents movement of the drill bit in an uphole direction.

9. The apparatus of claim 8, further comprising a first stop member positioned between said at least one first biasing member and the spring mandrel for limiting movement of the first piston and a second stop member positioned between said at least one second biasing member and the spring mandrel for limiting movement of the second piston.

10. The apparatus of claim 8, wherein said at least one first biasing member, said at least one second biasing member, or combinations thereof, comprises at least one Bellville spring.

11. The apparatus of claim 8, further comprising a first spring housing positioned between the spring mandrel and the first piston, wherein the first spring housing comprises a tubular member, and wherein said at least one first biasing member comprises at least one spring positioned along an exterior surface of the tubular member.

12. The apparatus of claim 8, further comprising a second spring housing positioned between the spring mandrel and the second piston, wherein the second spring housing comprises a tubular member, and wherein said at least one second biasing member comprises at least one spring positioned along an exterior surface of the tubular member.

13. The apparatus of claim 8, further comprising a spline engagement between the first mandrel and the tubular housing, between the second mandrel and the tubular housing, or combinations thereof.

* * * * *